US008933857B2

(12) United States Patent
Ryu

(10) Patent No.: US 8,933,857 B2
(45) Date of Patent: Jan. 13, 2015

(54) ANTENNA DEVICE AND MOBILE TERMINAL HAVING THE SAME

(75) Inventor: Seungwoo Ryu, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 176 days.

(21) Appl. No.: 13/536,714

(22) Filed: Jun. 28, 2012

(65) Prior Publication Data

US 2013/0113674 A1 May 9, 2013

(30) Foreign Application Priority Data

Nov. 7, 2011 (KR) ..... 10-2011-0115269

(51) Int. Cl.

| | |
|---|---|
| ***H01Q 1/48*** | (2006.01) |
| ***H01Q 9/04*** | (2006.01) |
| *H01Q 1/24* | (2006.01) |
| *H01Q 21/30* | (2006.01) |

(52) U.S. Cl.

CPC ..... *H01Q 1/48* (2013.01); *H01Q 1/243* (2013.01); *H01Q 9/0485* (2013.01); *H01Q 21/30* (2013.01)

USPC ..... 343/848; 343/702

(58) Field of Classification Search

CPC ..... H01Q 5/01; H01Q 9/04; H01Q 9/0485; H01Q 1/48; H01Q 1/243; H01Q 21/30

USPC ..... 343/848, 702, 846

See application file for complete search history.

(56) References Cited

U.S. PATENT DOCUMENTS

| | | | | |
|---|---|---|---|---|
| 7,545,327 | B2 * | 6/2009 | Iellici et al. | 343/700 MS |
| 2002/0180646 | A1 * | 12/2002 | Kivekas et al. | 343/700 MS |
| 2013/0049892 | A1 * | 2/2013 | Hendry et al. | 333/202 |
| 2013/0049901 | A1 * | 2/2013 | Hendry et al. | 333/208 |

* cited by examiner

*Primary Examiner* — Hoanganh Le

(74) *Attorney, Agent, or Firm* — Birch, Stewart, Kolasch & Birch, LLP

(57) ABSTRACT

An antenna device including a dielectric resonator antenna configured to generate resonances in a first frequency band; a printed circuit board electrically connected to the dielectric resonator antenna and configured to process radio signals; and a defected ground structure formed on the printed circuit board and configured to generate resonances in a second frequency band using a current flowing on the dielectric resonator antenna and the printed circuit board.

18 Claims, 11 Drawing Sheets

ANTENNA DEVICE AND MOBILE TERMINAL HAVING THE SAME

CROSS-REFERENCE TO RELATED APPLICATIONS

Pursuant to 35 U.S.C. §119(a), this application claims the benefit of earlier filing date and right of priority to Korean Application No. 10-2011-0115269, filed on Nov. 7, 2011, the contents of which is incorporated by reference herein in its entirety.

BACKGROUND OF THE INVENTION

1. Field of the Invention

This specification relates to an antenna device allowing for transmission and reception of electric waves and a mobile terminal having the same.

2. Background of the Invention

Mobile terminals are electronic devices which are portable and have at least one of voice and telephone call functions, information input and/or output functions, a data storage function and the like. The mobile terminal is multifunctional and can be used to capture still images or moving images, play music or video files, play games, receive broadcast and the like, so as to be implemented as an integrated multimedia player.

As the mobile terminal becomes more and more complex, the user interface needed to handle the various functions has become more complicated. The electrical components within the mobile terminal have also increased in number and become more complex.

Some mobile terminals operate in multiple frequency bands. This also complicates the structure of an antenna included in the mobile terminal and makes it difficult to independently tune parameter values for deciding characteristics such as resonant frequency, bandwidth, gain and the like.

SUMMARY OF THE INVENTION

Accordingly, one object of the present invention is to address the above-noted and other problems of the related art.

Yet another object of the present invention is to provide an antenna device forming a resonance in low and high frequency bands, and a mobile terminal having the same.

Another aspect of the present invention is to provide an antenna device having a reduced size and improved radiation efficiency, and a mobile terminal having the same.

To achieve these and other advantages and in accordance with the purpose of this specification, as embodied and broadly described herein, the present invention provides in one aspect an antenna device including a dielectric resonator antenna configured to generate resonances in a first frequency band; a printed circuit board electrically connected to the dielectric resonator antenna and configured to process radio signals; and a defected ground structure formed on the printed circuit board and configured to generate resonances in a second frequency band using a current flowing on the dielectric resonator antenna and the printed circuit board.

In another aspect, the present invention provides a mobile terminal including a terminal body; a printed circuit board mounted inside the terminal body and having a ground; a dielectric resonator antenna configured to generate resonances in a first frequency band; and a defected ground structure formed on the printed circuit board and configured to generate resonances in a second frequency band using a current flowing on the dielectric resonator antenna and the printed circuit board.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of a mobile terminal according to the exemplary embodiments, with reference to the accompanying drawings. For the sake of brief description with reference to the drawings, the same or equivalent components will be provided with the same reference numbers, and description thereof will not be repeated. Hereinafter, suffixes "module" and "unit or portion" for components used herein in description are merely provided only for facilitation of preparing this specification, and thus they are not granted a specific meaning or function.

Mobile terminals described in this specification may include cellular phones, smart phones, laptop computers, digital broadcasting terminals, personal digital assistants (PDAs), portable multimedia players (PMPs), E-books, navigators, and the like.

Figure 1:
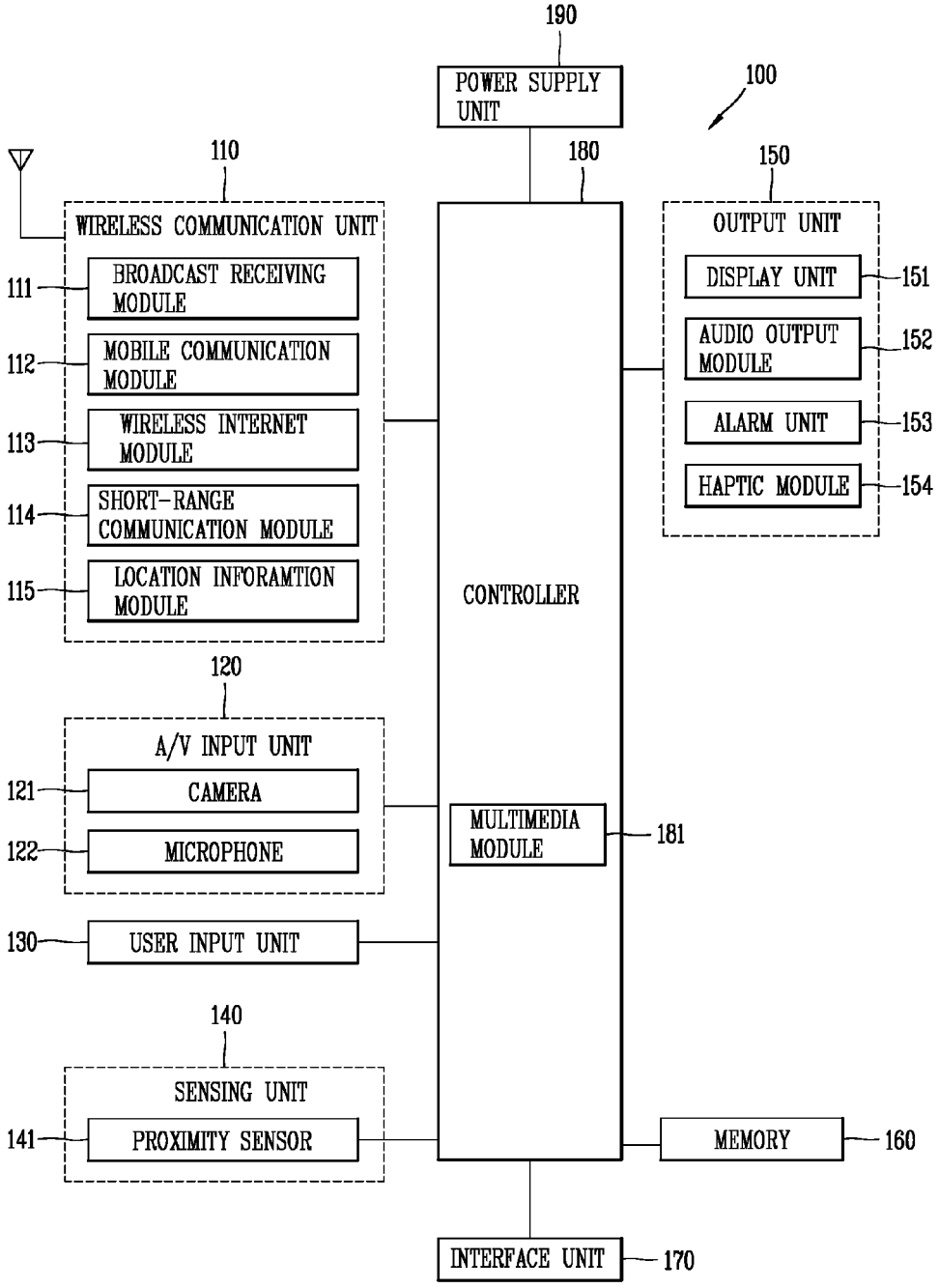
FIG. 1 is a block diagram of a mobile terminal in accordance with one embodiment of the present invention.

FIG. 1 is a block diagram of a mobile terminal 100 in accordance with one embodiment of the present invention The mobile terminal 100 may include components, such as a wireless communication unit 110, an Audio/Video (A/V) input unit 120, a user input unit 130, a sensing unit 140, an output unit 150, a memory 160, an interface unit 170, a controller 180, a power supply 190 and the like. FIG. 1 shows the mobile terminal 100 having various components, but it is understood that implementing all of the illustrated components is not a requirement. Greater or fewer components may alternatively be implemented.

The wireless communication unit 110 generally includes one or more modules which permit wireless communications between the mobile terminal 100 and a wireless communication system or between the mobile terminal 100 and a network within which the mobile terminal 100 is located. For example, the wireless communication unit 110 may include a broadcast receiving module 111, a mobile communication module 112, a wireless Internet module 113, a short-range communication module 114, a location information module 115 and the like.

The broadcast receiving module 111 receives a broadcast signal and/or broadcast associated information from an external broadcast managing entity via a broadcast channel. The broadcast channel may include a satellite channel and a terrestrial channel. The broadcast managing entity may indicate a server which generates and transmits a broadcast signal and/or broadcast associated information or a server which receives a pre-generated broadcast signal and/or broadcast associated information and sends them to the mobile terminal. The broadcast signal may be implemented as a TV broadcast signal, a radio broadcast signal, and a data broadcast signal, among others. The broadcast signal may further include a data broadcast signal combined with a TV or radio broadcast signal.

Examples of broadcast associated information include information associated with a broadcast channel, a broadcast program, a broadcast service provider, and the like. The broadcast associated information may be provided via a mobile communication network, and received by the mobile communication module 112. The broadcast associated information may be implemented in various formats. For instance, broadcast associated information may include an Electronic Program Guide (EPG) of the Digital Multimedia Broadcasting (DMB), Electronic Service Guide (ESG) of Digital Video Broadcast-Handheld (DVB-H) systems, and the like.

Further, the broadcast receiving module 111 can receive digital broadcast signals transmitted from various types of broadcast systems. Such broadcast systems include Digital Multimedia Broadcasting-Terrestrial (DMB-T), Digital Multimedia Broadcasting-Satellite (DMB-S), Media Forward Link Only (MediaFLO), Digital Video Broadcast-Handheld (DVB-H), Integrated Services Digital Broadcast-Terrestrial (ISDB-T) systems and the like. The broadcast receiving module 111 may be configured to be suitable for every broadcast system transmitting broadcast signals as well as the digital broadcasting systems.

Broadcast signals and/or broadcast associated information received via the broadcast receiving module 111 may also be stored in a suitable device, such as a memory 160.

In addition, the mobile communication module 112 transmits/receives wireless signals to/from at least one of network entities (e.g., base station, an external mobile terminal, a server, etc.) on a mobile communication network. Here, the wireless signals may include audio call signal, video (telephony) call signal, or various formats of data according to transmission/reception of text/multimedia messages.

The wireless Internet module 113 supports wireless Internet access for the mobile terminal. This module may be internally or externally coupled to the mobile terminal 100. Examples of such wireless Internet access include Wireless LAN (WLAN) (Wi-Fi), Wireless Broadband (Wibro), Worldwide Interoperability for Microwave Access (Wimax), High Speed Downlink Packet Access (HSDPA) and the like.

The short-range communication module 114 denotes a module for short-range communications. Suitable technologies for implementing this module may include BLUETOOTH™, Radio Frequency IDentification (RFID), Infrared Data Association (IrDA), Ultra-WideBand (UWB), ZigBee™, and the like. Further, the location information module 115 denotes a module for detecting or calculating a position of a mobile terminal. An example of the location information module 115 may include a Global Position System (GPS) module.

Referring to FIG. 1, the A/V input unit 120 is configured to provide audio or video signal input to the mobile terminal. The A/V input unit 120 may include a camera 121 and a microphone 122. The camera 121 receives and processes image frames of still pictures or video obtained by image sensors in a video call mode or a capturing mode. The processed image frames may be displayed on a display unit 151.

The image frames processed by the camera 121 may be stored in the memory 160 or transmitted to the exterior via the wireless communication unit 110. Two or more cameras 121 may be provided according to the configuration of the mobile terminal. The microphone 122 may receive an external audio signal while the mobile terminal is in a particular mode, such as a phone call mode, a recording mode, a voice recognition mode, or the like. This audio signal is processed into digital data. The processed digital data is converted for output into a format transmittable to a mobile communication base station via the mobile communication module 112 in case of the phone call mode. The microphone 122 may include assorted noise removing algorithms to remove noise generated in the course of receiving the external audio signal.

The user input unit 130 may generate input data input by a user to control the operation of the mobile terminal. The user input unit 130 may include a keypad, a dome switch, a touchpad (e.g., static pressure/capacitance), a jog wheel, a jog switch and the like. The sensing unit 140 provides status measurements of various aspects of the mobile terminal. For instance, the sensing unit 140 may detect an open/close status of the mobile terminal, a change in a location of the mobile terminal 100, a presence or absence of user contact with the mobile terminal 100, the location of the mobile terminal 100, acceleration/deceleration of the mobile terminal 100, and the like, so as to generate a sensing signal for controlling the operation of the mobile terminal 100. For example, regarding a slide-type mobile terminal, the sensing unit 140 may sense whether a sliding portion of the mobile terminal is open or closed. Other examples include sensing functions, such as the sensing unit 140 sensing the presence or absence of power provided by the power supply 190, the presence or absence of a coupling or other connection between the interface unit 170 and an external device. Meanwhile, the sensing unit 140 may include a proximity sensor 141.

The output unit 150 is configured to output an audio signal, a video signal or a tactile signal. The output unit 150 may include a display unit 151, an audio output module 152, an alarm unit 153 and a haptic module 154. Also, the display unit 151 may output information processed in the mobile terminal 100. For example, when the mobile terminal is operating in a phone call mode, the display unit 151 will provide a User Interface (UI) or a Graphic User Interface (GUI), which includes information associated with the call. As another example, if the mobile terminal is in a video call mode or a capturing mode, the display unit 151 may additionally or alternatively display images captured and/or received, UI, or GUI.

The display unit 151 may be implemented using, for example, at least one of a Liquid Crystal Display (LCD), a Thin Film Transistor-Liquid Crystal Display (TFT-LCD), an Organic Light-Emitting Diode (OLED), a flexible display, a three-dimensional (3D) display, or the like.

Some of such displays 151 may be implemented as a transparent type or an optical transparent type through which the exterior is visible, which is referred to as 'transparent display'. A representative example of the transparent display may include a Transparent OLED (TOLED), and the like. The rear surface of the display unit 151 may also be implemented to be optically transparent. Under this configuration, a user can view an object positioned at a rear side of a terminal body through a region occupied by the display unit 151 of the terminal body.

The display unit 151 may be implemented in two or more in number according to a configured aspect of the mobile terminal 100. For instance, a plurality of the displays 151 may be arranged on one surface to be spaced apart from or integrated with each other, or may be arranged on different surfaces.

Here, if the display unit 151 and a touch sensitive sensor (referred to as a touch sensor) have a layered structure therebetween, the structure may be referred to as a touch screen. The display unit 151 may be used as an input device rather than an output device. The touch sensor may be implemented as a touch film, a touch sheet, a touch pad, and the like.

The touch sensor may be configured to convert changes of a pressure applied to a specific part of the display unit 151, or a capacitance occurring from a specific part of the display unit 151, into electric input signals. Also, the touch sensor may be configured to sense not only a touched position and a touched area, but also a touch pressure.

When touch inputs are sensed by the touch sensors, corresponding signals are transmitted to a touch controller. The touch controller processes the received signals, and then transmits corresponding data to the controller 180. Accordingly, the controller 180 may sense which region of the display unit 151 has been touched.

Still referring to FIG. 1, a proximity sensor 141 may be arranged at an inner region of the mobile terminal 100 covered by the touch screen, or near the touch screen. The proximity sensor 141 indicates a sensor to sense presence or absence of an object approaching to a surface to be sensed, or an object disposed near a surface to be sensed, by using an electromagnetic field or infrared rays without a mechanical contact. The proximity sensor 141 has a longer lifespan and a more enhanced utility than a contact sensor.

The proximity sensor 141 may include a transmissive type photoelectric sensor, a direct reflective type photoelectric sensor, a mirror reflective type photoelectric sensor, a high-frequency oscillation proximity sensor, a capacitance type proximity sensor, a magnetic type proximity sensor, an infrared rays proximity sensor, and so on. When the touch screen is implemented as a capacitance type, proximity of a pointer to the touch screen is sensed by changes of an electromagnetic field. In this instance, the touch screen (touch sensor) may be categorized into a proximity sensor.

Hereinafter, for the sake of brief explanation, a status that the pointer is positioned to be proximate onto the touch screen without contact will be referred to as 'proximity touch', whereas a status that the pointer substantially comes in contact with the touch screen will be referred to as 'contact touch'. For the position corresponding to the proximity touch of the pointer on the touch screen, such position corresponds to a position where the pointer faces perpendicular to the touch screen upon the proximity touch of the pointer.

The proximity sensor 141 senses proximity touch, and proximity touch patterns (e.g., distance, direction, speed, time, position, moving status, etc.). Information relating to the sensed proximity touch and the sensed proximity touch patterns may be output onto the touch screen.

The audio output module 152 may output audio data received from the wireless communication unit 110 or stored in the memory 160, in a call-receiving mode, a call-placing mode, a recording mode, a voice recognition mode, a broadcast reception mode, and so on. The audio output module 152 may output audio signals relating to functions performed in the mobile terminal 100, e.g., sound alarming a call received or a message received, and so on. The audio output module 152 may include a receiver, a speaker, a buzzer, and so on.

The alarm unit 153 outputs signals notifying occurrence of events from the mobile terminal 100. The events occurring from the mobile terminal 100 may include call received, message received, key signal input, touch input, and so on. The alarm unit 153 may output not only video or audio signals, but also other types of signals such as signals notifying occurrence of events in a vibration manner. Since the video or audio signals can be output through the display unit 151 or the audio output module 152, the display unit 151 and the audio output module 152 may be categorized into a part of the alarm unit 153.

The haptic module 154 generates various tactile effects which a user can feel. A representative example of the tactile effects generated by the haptic module 154 includes vibration. Vibration generated by the haptic module 154 may have a controllable intensity, a controllable pattern, and so on. For instance, different vibration may be output in a synthesized manner or in a sequential manner.

The haptic module 154 may generate various tactile effects, including not only vibration, but also arrangement of pins vertically moving with respect to a skin being touched (contacted), air injection force or air suction force through an injection hole or a suction hole, touch by a skin surface, presence or absence of contact with an electrode, effects by stimulus such as an electrostatic force, reproduction of cold or hot feeling using a heat absorbing device or a heat emitting device, and the like.

The haptic module 154 may be configured to transmit tactile effects (signals) through a user's direct contact, or a user's muscular sense using a finger or a hand. The haptic module 154 may be implemented in two or more in number according to the configuration of the mobile terminal 100.

The memory 160 may store a program for the processing and control of the controller 180. Alternatively, the memory 160 may temporarily store input/output data (e.g., phonebook data, messages, still images, video and the like). Also, the memory 160 may store data related to various patterns of vibrations and audio output upon the touch input on the touch screen.

The memory 160 may be implemented using any type of suitable storage medium including a flash memory type, a hard disk type, a memory card type (e.g., SD or DX memory), Random Access Memory (RAM), Static Random Access Memory (SRAM), Read-Only Memory (ROM), Electrically Erasable Programmable Read-Only Memory (EEPROM), Programmable Read-Only Memory (PROM), magnetic memory, magnetic disk, optical disk, and the like. Also, the mobile terminal 100 may operate a web storage which performs the storage function of the memory 160 on the Internet.

The interface unit 170 may generally be implemented to interface the mobile terminal with external devices. The interface unit 170 may allow a data reception from an external device, a power delivery to each component in the mobile terminal 100, or a data transmission from the mobile terminal 100 to an external device. The interface unit 170 may include, for example, wired/wireless headset ports, external charger ports, wired/wireless data ports, memory card ports, ports for coupling devices having an identification module, audio Input/Output (I/O) ports, video I/O ports, earphone ports, and the like.

The identification module may be configured as a chip for storing various information required to authenticate an authority to use the mobile terminal 100, which may include a User Identity Module (UIM), a Subscriber Identity Module (SIM), and the like. Also, the device having the identification module (hereinafter, referred to as 'identification device') may be implemented in a type of smart card. Hence, the identification device can be coupled to the mobile terminal 100 via a port.

Also, the interface unit 170 may serve as a path for power to be supplied from an external cradle to the mobile terminal 100 when the mobile terminal 100 is connected to the external cradle or as a path for transferring various command signals input from the cradle by a user to the mobile terminal 100. Such various command signals or power input from the cradle may operate as signals for recognizing that the mobile terminal 100 has accurately been mounted to the cradle.

The controller 180 typically controls the overall operations of the mobile terminal 100. For example, the controller 180 performs the control and processing associated with telephony calls, data communications, video calls, and the like. The controller 180 may include a multimedia module 181 which provides multimedia playback. The multimedia module 181 may be configured as part of the controller 180 or as a separate component. The controller 180 can perform a pattern recognition processing so as to recognize writing or drawing input on the touch screen as text or image.

The power supply 190 provides power required by various components under the control of the controller 180. The provided power may be internal power, external power, or combination thereof.

Various embodiments described herein may be implemented in a computer-readable medium using, for example, software, hardware, or some combination thereof.

For a hardware implementation, the embodiments described herein may be implemented within one or more Application Specific Integrated Circuits (ASICs), Digital Signal Processors (DSPs), Digital Signal Processing Devices (DSPDs), Programmable Logic Devices (PLDs), Field Programmable Gate Arrays (FPGAs), processors, microprocessors, other electronic units designed to perform the functions described herein, or a selective combination thereof. In some cases, such embodiments are implemented by the controller 180.

For a software implementation, the embodiments such as procedures and functions may be implemented together with separate software modules each of which performs at least one of functions and operations. The software codes can be implemented with a software application written in any suitable programming language. Also, the software codes may be stored in the memory 160 and executed by the controller 180.

Figure 2:
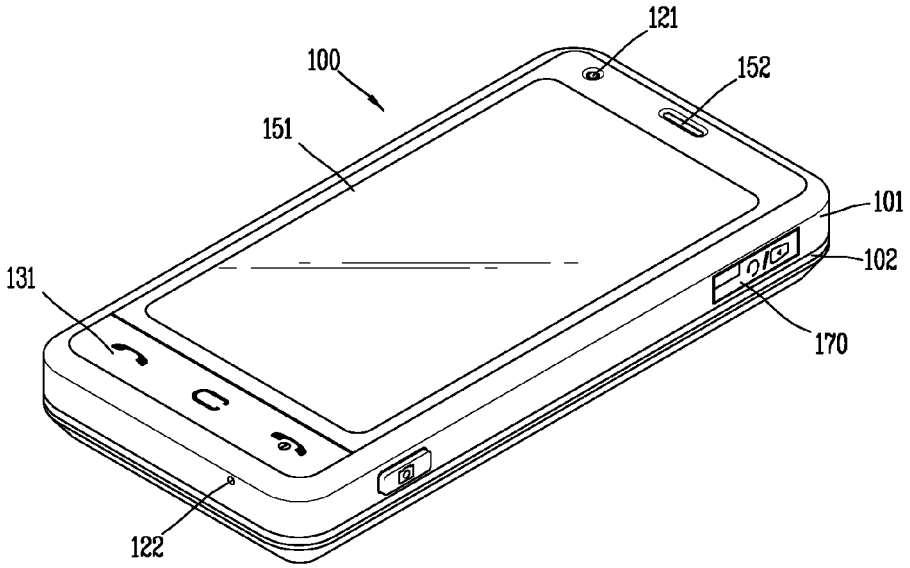
FIG. 2 is a front perspective view of the mobile terminal.

Next, FIG. 2 is a front perspective view of the mobile terminal 100 according to one embodiment of the present invention. The mobile terminal 100 shown in FIG. 2 is a bar type mobile terminal. However, this detailed description may be applicable, but not limited to, a various structures, such as a slide type, a folder type, a swing type, a swivel type and the like, having two or more bodies coupled to be relatively movable with each other.

A body may include a case (or referred to as casing, housing, cover, etc.) defining an appearance of the mobile terminal 100. In this exemplary embodiment, the case may be divided into a front case 101 and a rear case 102. A space formed between the front and rear cases 101 and 102 may accommodate various electronic components. At least one intermediate case may further be disposed between the front and the rear cases 101 and 102.

Such cases may be injected using a synthetic resin or be formed of a metal, such as stainless steel (STS), titanium (Ti) or the like. The terminal body is shown having a display module 210 (see FIG. 4), an audio output module 152, a camera 121, a user input unit 130/131, 132, a microphone 122, an interface unit 170, and the like.

The display module 200 may occupy most of a principal surface of the front case 101. The audio output module 152 and the camera 121 may be disposed near one of both end portions of the display module 210, and the user input unit 131 and the microphone 122 on the other end portion of the display module 210. The user input unit 132, the interface unit 170 and the like may be disposed on side surfaces of the front and rear cases 101 and 102.

The user input unit 130 may be manipulated to allow inputting of commands for controlling operations of the mobile terminal 100, and include a plurality of first manipulation units 131, 132. The plurality of manipulation units 131, 132 may be referred to as a manipulating portion. Such manipulating portion can employ any tactile manner that a user can touch or tap for manipulation.

The first and second manipulation units 131, 132 may be set to allow inputting of various contents. For example, the first manipulation unit 131 may be configured to input commands such as START, END, SCROLL or the like, and the second manipulation unit 132 may be configured to input commands, such as a volume adjustment of sounds output from the audio output module 152, conversion of the display module 210 into a touch recognition mode, or the like.

Figure 3:
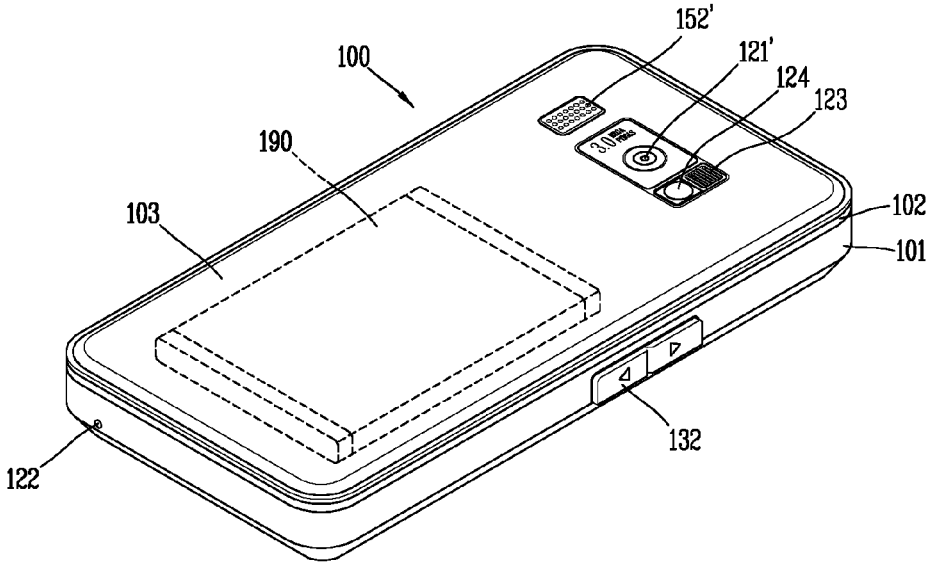
FIG. 3 is a rear perspective view of the mobile terminal shown in FIG. 2.

FIG. 3 is a rear perspective view of the mobile terminal 100 shown in FIG. 2.

As shown in FIG. 3, a rear face of the terminal body, namely, the rear case 102 may further be provided with a camera 121'. The camera 121' faces a direction which is opposite to a direction faced by the camera 121 (see FIG. 2), and may have different pixels from those of the camera 121.

For example, the camera 121 may operate with relatively lower pixels (lower resolution). Thus, the camera 121 may be useful when a user can capture his face and send it to another party during a video call or the like. On the other hand, the camera 121' may operate with a relatively higher pixels (higher resolution) such that it can be useful for a user to obtain higher quality pictures for later use. The cameras 121 and 121' may be installed in the terminal body to be rotatable or popped up.

A flash 123 and a mirror 124 may additionally be disposed adjacent to the camera 121'. The flash 123 operates in conjunction with the camera 121' when taking a picture using the camera 121'. The mirror 124 can cooperate with the camera 121' to allow a user to photograph himself in a self-portrait mode. An audio output module 152' may further be disposed at a rear face of the terminal body. The audio output module 152' can cooperate with the audio output module 152 (see FIG. 2) to provide stereo output. Also, the audio output module 152' may be configured to operate as a speakerphone.

A broadcast signal receiving antenna (not shown) may further be disposed at one side of the terminal body in addition to an antenna for communications, for example. The antenna 124 configuring a part of the broadcast receiving module 111 (see FIG. 1) may be retractable into the terminal body.

A power supply unit 190 for supplying power to the mobile terminal 100 may be mounted in the terminal body. The power supply unit 190 may be implemented as a battery 191 (see FIG. 4). The power supply unit 190 may be mounted in the terminal body or detachably coupled directly onto the outside of the terminal body. A battery cover 103 for restricting separation of the battery 191 may be detachably coupled to the rear case 102.

Figure 4:
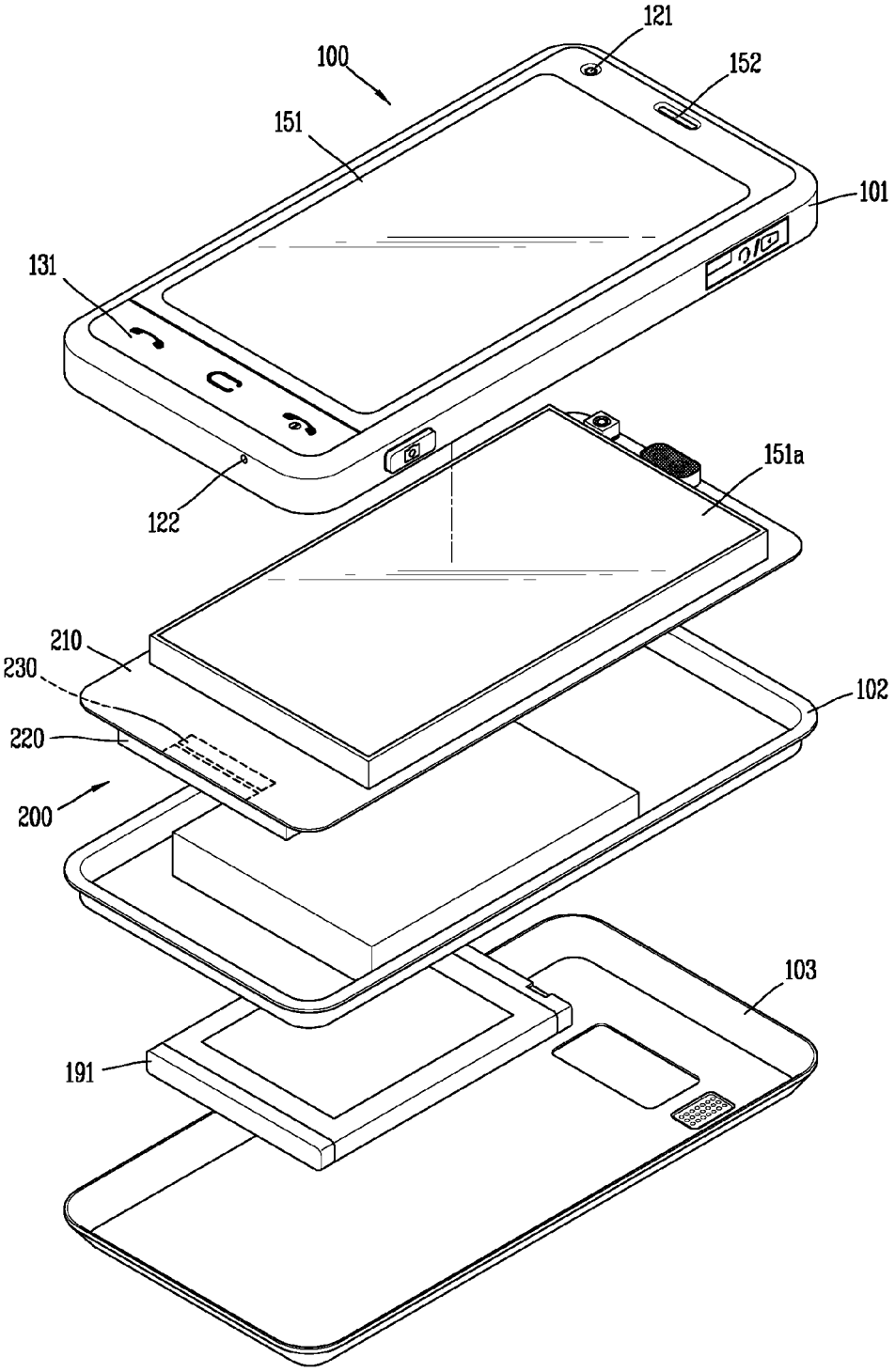
FIG. 4 is a disassembled perspective view of the mobile terminal of FIG. 2.

Next, FIG. 4 is a disassembled perspective view of the mobile terminal of FIG. 2, which shows an antenna device 200 installed inside the terminal body. As shown in FIG. 4, a printed circuit board 210 can be disposed at an inner space of the terminal body. The printed circuit board 210 can be mounted to occupy a principal surface of the terminal body. The printed circuit board 210 may be implemented as one example of the controller 180 (see FIG. 1) for controlling the mobile terminal 100 to operate various functions thereof. For example, the printed circuit board 210 may allow the display 151*a* to display (output) information processed in the mobile terminal 100.

Electronic devices for activating (enabling) various functions of the mobile terminal 100 may be mounted on at least one surface of the printed circuit board 210. For example, the display 151*a*, the audio output module 152, the camera 121, and the like can be mounted onto one surface of the printed circuit board 210.

Further, the antenna device 200 for transmission and reception of electric waves can be disposed at one side (or one surface) of the printed circuit board 210. The antenna device 200 may be disposed at one end of the terminal body, for example, at a position spaced from the audio output module 152, namely, a position adjacent to the microphone 122 so as to minimize an effect of electric waves on users. The antenna device 200 may also be provided in plurality with different functions. The plurality of antenna devices 200 may be disposed with a spaced distance therebetween to minimize interference therebetween. For example, the plurality of antenna devices 200 may be disposed at both ends of the mobile terminal 100 in a lengthwise direction with the display 151*a* interposed therebetween.

Hereinafter, a description will be given in detail of a dual-band antenna device 200, which has a reduced size and improved radiation efficiency, and forms resonance in low and high frequency bands according to an embodiment of the present invention.

Figure 5:
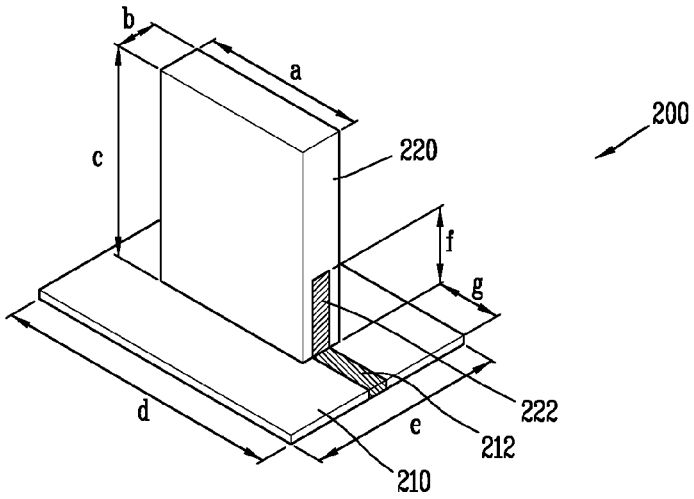
FIGS. 5 and 6 are perspective views showing an antenna device shown in FIG. 4, viewed from one surface and another surface of a printed circuit board, respectively.
Figure 6:
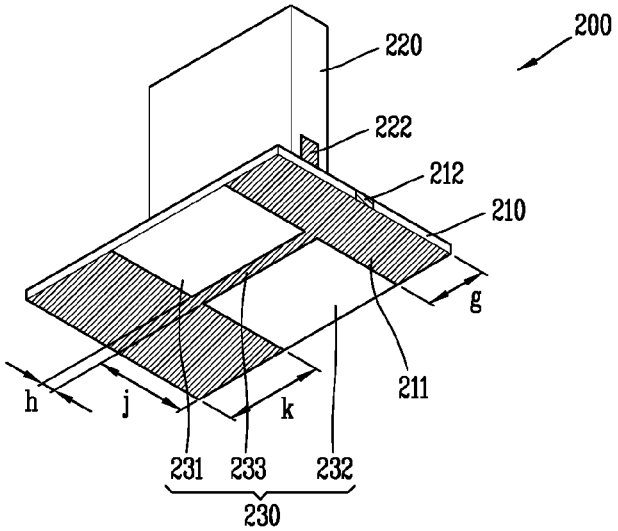
Figure 7:
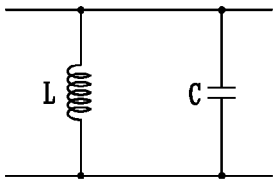
FIG. 7 is an equivalent circuit view of a Defected Ground Structure (DGS) of FIG. 6.

FIGS. 5 and 6 are perspective views showing the antenna device shown in FIG. 4, viewed from one surface and another surface of the printed circuit board, respectively, and FIG. 7 is an equivalent circuit view of a defected ground structure of FIG. 6. As shown in FIGS. 5 and 6, the antenna device 200 includes the printed circuit board 210, a Dielectric Resonator Antenna (DRA) 220, and a Defected Ground Structure (DGS) 230.

The printed circuit board 210 can be electrically connected to the DRA 220 so as to process transmitted and received radio (wireless) signals. As shown, the printed circuit board 210 includes a ground 211 having a shape of a conductive plate formed on the printed circuit board 210. This embodiment also illustrates that the ground 211 is formed inside the printed circuit board 210, and an insulating material is disposed outside the ground 211.

Further, the DRA 220 can be electrically connected to the ground 211, and configured to transmit and receive electric waves using resonance through a dielectric. In particular, the DRA 220 is an antenna using a dielectric resonator defined as a high dielectric low loss material, and may be designed in various shapes (for example, hexahedron, cylinder, cone, etc.) to be appropriate for a specific band.

The DRA 220 may also have radiating and loading characteristics, as the characteristics of a material antenna. In more detail, the DRA 220 may be connected to the ground 211 to be fed therefrom and generate a predetermined radiation pattern so as to output an RF signal or receive an external RF signal. Also, the DRA 220, as will be explained later, may load the DGS 230, in detail, a ground part 233, to generate the predetermined radiation pattern.

Further, the DGS 230 can be formed on the printed circuit board 210, and is formed, for example, by etching an insulating structure in the ground 211. The DGS 230 exhibits characteristics of interfering a signal in a specific band and also reducing a signal transmission speed. The DGS 230 also allows for transmission and reception of electric waves using a current flowing on the DRA 220 and the ground 211.

In addition, the DGS 230 may be formed on the ground 211 in various geometric patterns. Explaining the DGS 230 illustrated in the drawing as one example, the DGS 230 includes first and second insulating parts 231 and 232 facing to each other with a preset interval therebetween. A space between the first and second insulating parts 231 and 232 may define the ground part 233 on which a current concentrates. As the current flowing on the ground part 233 flows along circumferences of the first and second insulating parts 231 and 232, respectively, and inductance and capacitance are formed, the DGS 230 operates as a radiator. In FIG. 6, the first and second insulating parts 231 and 232 are symmetrical to each other based on the ground part 233 interposed therebetween.

The DGS 230 may also be represented as an equivalent circuit shown in FIG. 7. The values L and C are associated with the shape of the first and second insulating parts 231 and 232 (or the shape of the ground part 233), and resonance characteristics in a low frequency band can be changed according to the variation of the shape. In more detail, the value L is associated with the circumference of the first and second insulating parts 231 and 232. As the circumference becomes longer, the value L increases. Also, the value C is associated with a distance between surfaces located at both sides of the ground part 233. As the distance becomes farther, the value C decreases.

In addition, the ground part 233 can overlap the DRA 220 in a thickness direction of the printed circuit board 210. With this structure, the ground part 233 is disposed adjacent to the DRA 220 with a preset interval therebetween so as to be coupled to each other, which derives an effect of increasing the value C. Consequently, the antenna can be designed to be shorter in length.

A transmission line 222 electrically connected to the DGS 230 is also disposed on the DRA 220. The transmission line 222, as shown in FIG. 5, can be disposed on a side wall of the DRA 220, and perpendicular to the printed circuit board 210. Alternatively, the transmission line 222 may be designed to cover the DRA 220 so as to have an increased length, thereby further lowering a high frequency band.

In addition, as shown in FIGS. 5 and 6, the printed circuit board 210 can be provided with a connection portion 212 having one end connected to the DGS 230, and the other end connected to the transmission line 222. Thus, the DRA 220 may be excited by a current flowing via the DGS 230, the connection portion 212 and the transmission line 222.

In more detail, a magnetic field is generated by the current and serves as a current source to excite the DRA 220. That is, the DRA 220 can be electrically fed by the magnetic current source. Here, a displacement current of a predetermined size flows on the DRA 220, thereby realizing a specific resonant frequency.

Hereinafter, a description will be given in detail of simulation results for the antenna device 200 having the structure of generating resonances in different frequency bands. The DRA 220 is designed to have a size of 14 mm(a)×5.08 mm(b)×18.3 mm(c) and a dielectric constant of 10.2, the ground 211 is designed to have a size of 25 mm(d)×20 mm(e), and detailed measurements of the transmission line 222, the connection portion 212 and the DGS 230 are f=6 mm, g=5.5 mm, h=1.6 mm, j=9.2 mm and k=9.5 mm.

Figure 8:
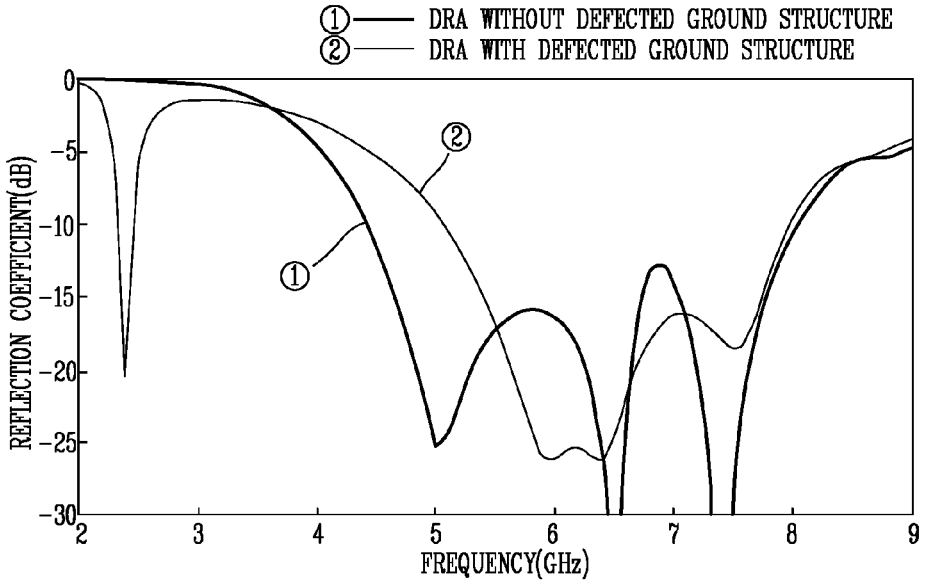
FIG. 8 is a graph for comparing a reflection coefficient of a dielectric resonator antenna according to whether or not a defected ground structure is present.
Figure 9:
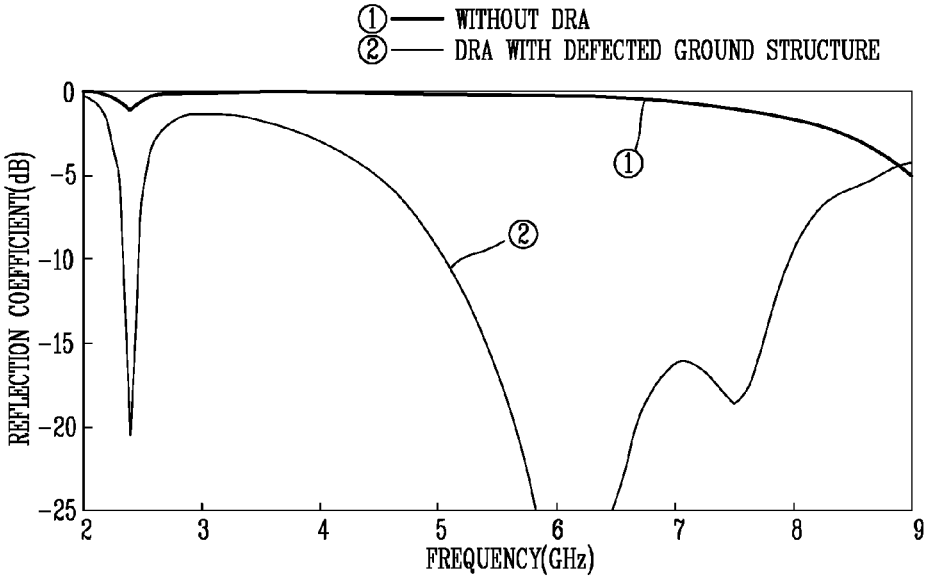
FIG. 9 is a graph for comparing a reflection coefficient of a defected ground structure according to whether or not a dielectric resonator antenna is present.

FIG. 8 is a graph for comparing a reflection coefficient of the DRA 220 according to whether or not the DGS 230 is present, and FIG. 9 is a graph for comparing a reflection coefficient of the DGS 230 according to whether or not the DRA 220 is present.

With the aforementioned configuration of the antenna device 200, the DRA 220 and the DGS 230 are interrelated with each other and generate resonances in different frequency bands, namely, a low frequency band and a high frequency band. For example, in order for the antenna device 200 to operate in the standard operating frequencies of IEEE802.11a/b/g, the low frequency band is approximately 2.4 GHz, and the high frequency band is approximately 5 GHz.

Referring to FIG. 8, the DRA 220, which is not coupled to the DGS 230, generates a single wideband of a high frequency band (covering approximately from 4.4 GHZ to 8 GHz) based on a reflection coefficient of −10 dB. On the contrary, the DRA 220 coupled to the DGS 230 generates a dual band covering a low frequency band as well as the high frequency band.

Referring to FIG. 9, the DGS 230 without being coupled to the DRA 220 merely exhibits a minute reflection coefficient in about 2.4 GHz but does not generate a specific band by itself. On the contrary, when the DGS 230 is coupled to the DRA 220, a dual band is generated in low and high frequency bands.

In more detail, the dual band results from the characteristics that the DRA 220 generates the resonances in the high frequency band, and the DGS 230, especially, the ground part 233 is electromagnetically connected to the DRA 220 so as to generate the resonances in the low frequency band. That is, according to this structure, with remaining the wideband characteristic of the DRA 220 in the high frequency band, the ground part 233 serves as a radiator and is coupled to the DRA 220 so as to generate the resonances in the low frequency band.

In more detail, the transmission line 222 is connected to the connection portion 212 so as to form impedance matching of the high frequency band, and the ground part 233 is connected to the connection portion 212 and the transmission line 222 so as to form impedance matching of the low frequency band. Especially, in the low frequency band, the DRA 220 can be loaded and the DGS 230 can radiate electric waves using a current concentrated on the ground part 233.

Figure 10A:
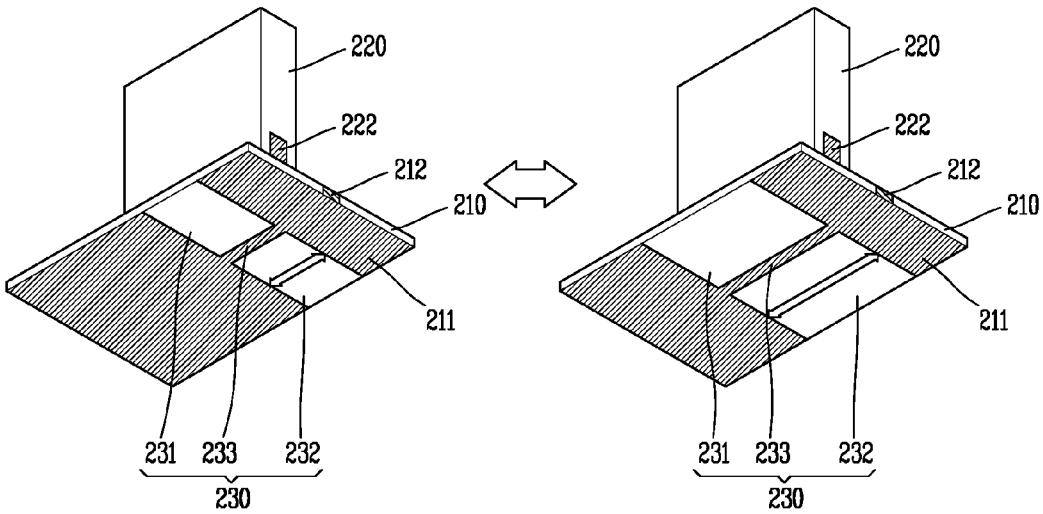
FIGS. 10A and 10B show one example of a shape variation of a defected ground structure and a graph for comparing a reflection coefficient according to the shape variation.
Figure 10B:
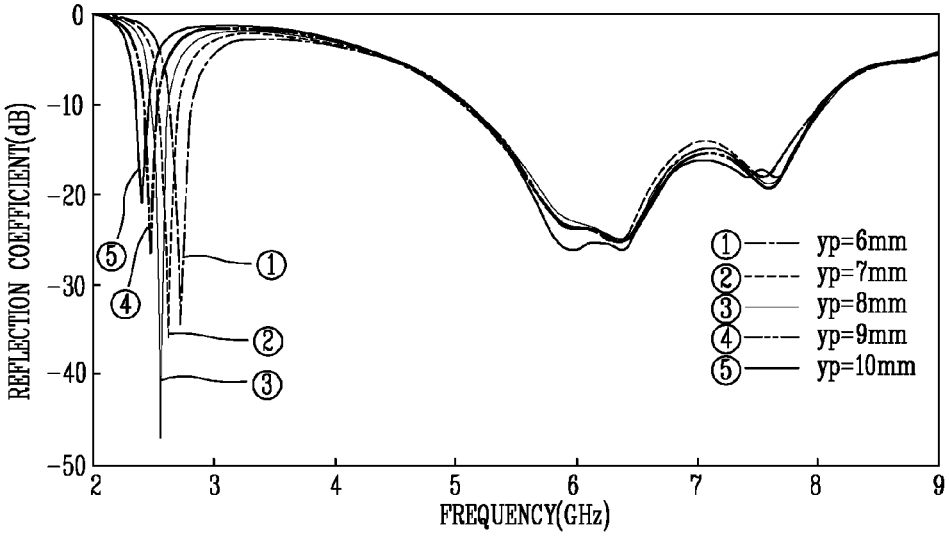
Figure 11A:
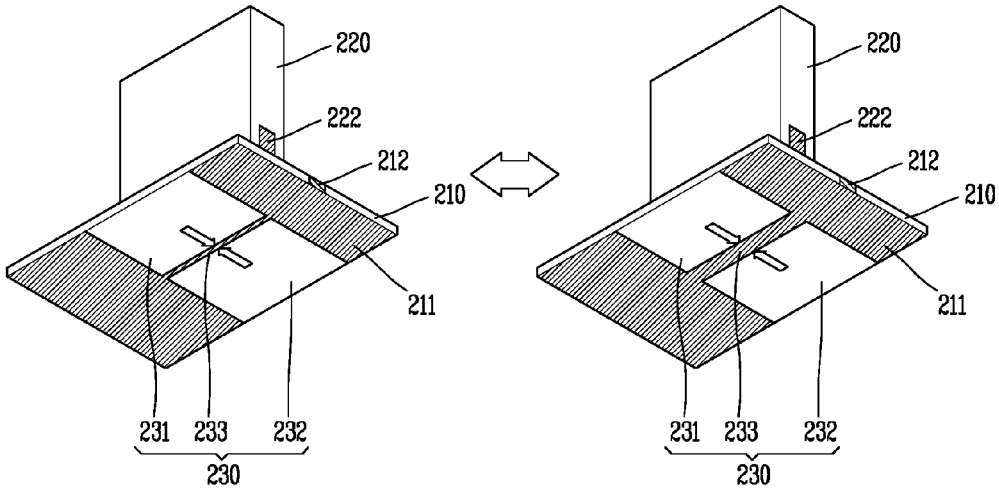
FIGS. 11A and 11B show another example of the shape variation of the defected ground structure and a graph for comparing a reflection coefficient according to the shape variation.
Figure 11B:
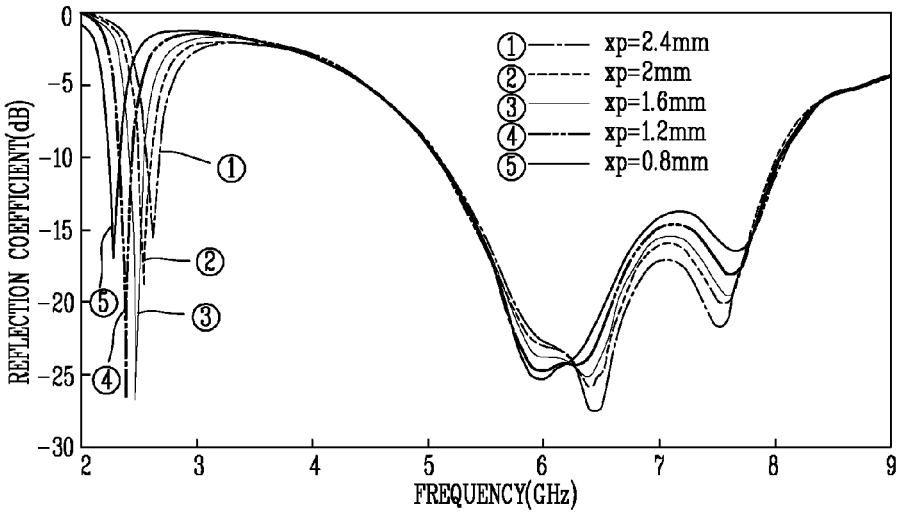

Next, FIGS. 10A and 10B show one example of a shape variation of the DGS 230 and a graph for comparing a reflection coefficient according to the shape variation. Further, FIGS. 11A and 11B show another example of the shape variation of the DGS 230 and a graph for comparing a reflection coefficient according to the shape variation.

As shown in the drawings, a low frequency band moves according to a shape variation of the DGS 230. On the other hand, a high frequency band rarely changes. This results from the low frequency band being excited by the current concentrated on the ground part 233 of the DGS 230.

Referring to FIGS. 10A and 10B, because a circumference and a length of each of the insulating parts 231 and 232 change, the value L and the value C of the equivalent circuit shown in FIG. 7 change, which results in variations of resonance characteristics such as frequencies and reflection coefficients in the low frequency band.

According to the simulation results, the frequencies of the low frequency band decrease upon an increase in a length (yp) of each insulating part 231 and 232 disposed at both sides of the ground part 233, and a reflection coefficient changes in response to the length (yp). In view of design conditions of this exemplary embodiment, the lowest reflection coefficient can be exhibited when the length (yp) is 8 mm.

Referring to FIGS. 11A and 11B, since a width (xp) of the ground part 233, namely, the circumference of each insulating part 231 and 232 changes, the value L of the equivalent circuit shown in FIG. 7 changes, which results in variations of resonance characteristics such as frequencies and reflection coefficients in the low frequency band.

According to the simulation results, the frequencies of the low frequency band decrease when the width (xp) of the ground part 233 is reduced, and the reflection coefficient changes in response to the width (xp). In view of design conditions of this embodiment, the lowest reflection coefficient can be exhibited when the width (xp) is 1.6 mm and 1.2 mm.

Figure 12A:
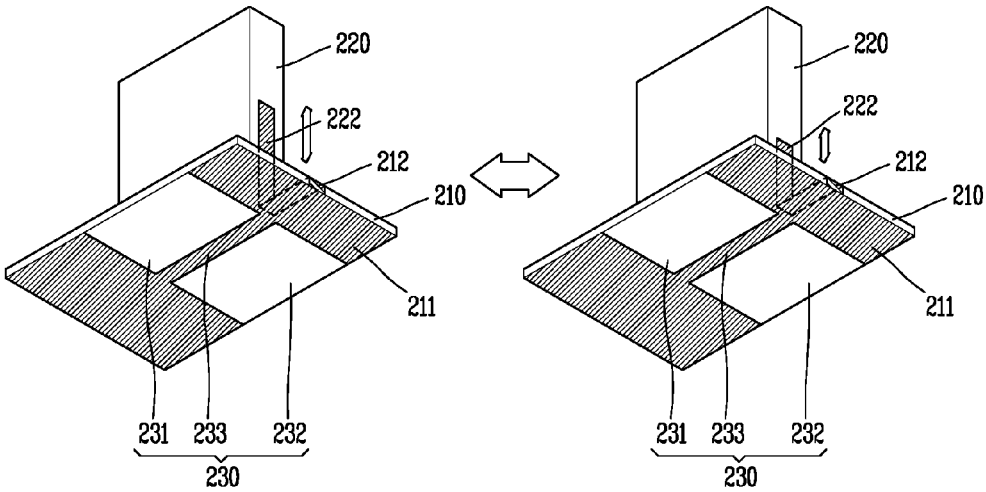
FIGS. 12A and 12B show an example of a feed length variation of a transmission line and a graph for comparing a reflection coefficient according to the feed length variation.
Figure 12B:
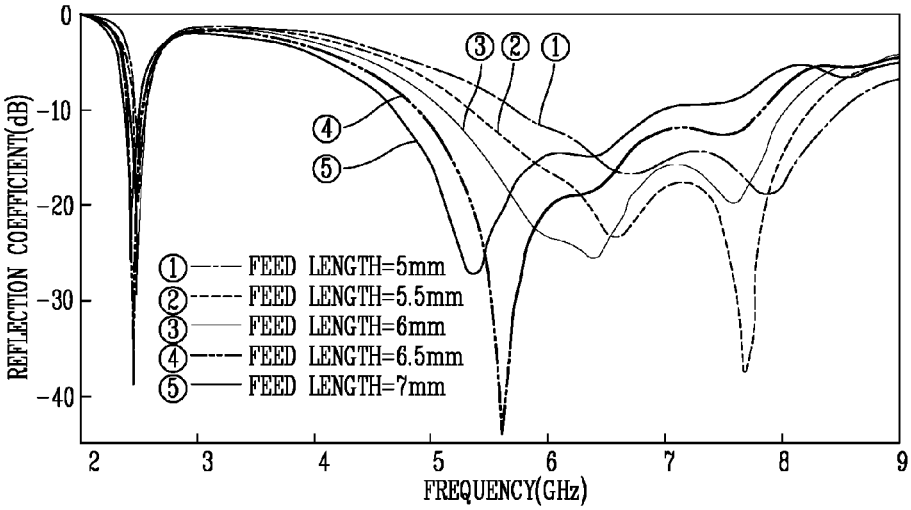
Figure 13A:
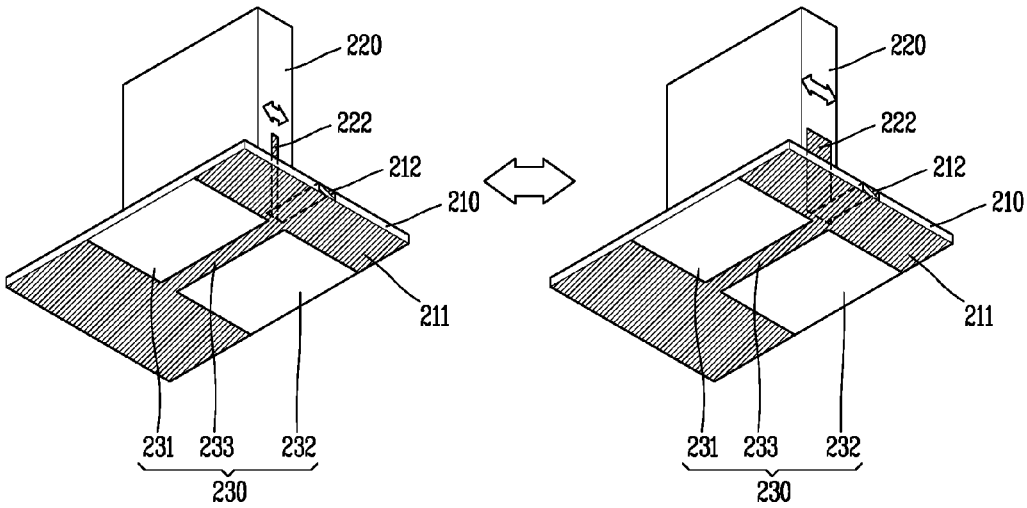
FIGS. 13A and 13B show an example of a feed width variation of a transmission line and a graph for comparing reflection coefficient according to the width variation.
Figure 13B:
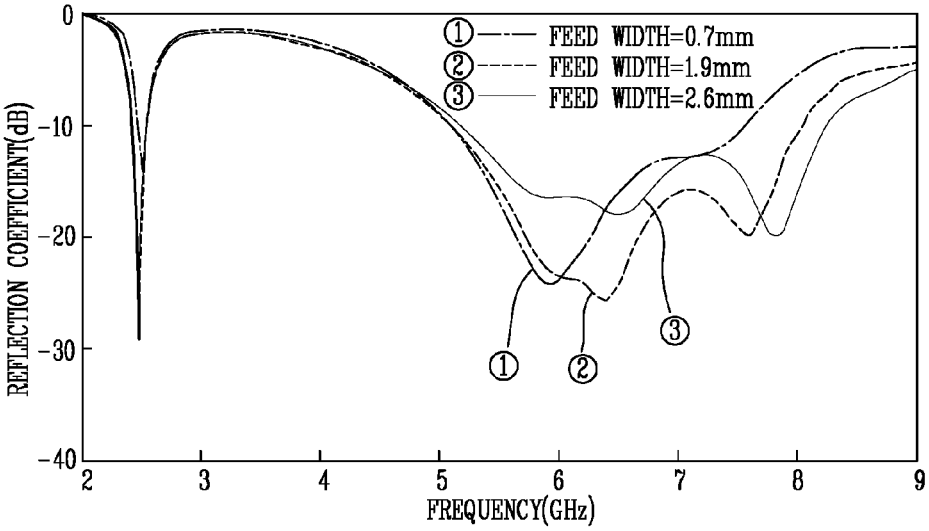

Next, FIGS. 12A and 12B show an example of a feed length variation of the transmission line 222 and a graph for comparing a reflection coefficient according to the feed length variation. In addition, FIGS. 13A and 13B show an example of a feed width variation of the transmission line 222 and a graph for comparing reflection coefficient according to the feed width variation.

As shown in the drawings, the resonance characteristics of a high frequency band change in response to variation of the shape of the transmission line 222. On the contrary, a low frequency band rarely changes. This is because the DRA 220 is excited by the transmission line 222 and the transmission line 222 is connected to the connection portion 212 so as to form an impedance matching of the high frequency band.

Referring to FIGS. 12A and 12B, frequencies of the high frequency band decrease as the feed length of the transmission line 222 becomes longer. Also, referring to FIGS. 13A and 13B, frequencies of the high frequency band increase as the width of the transmission line 222 becomes wider.

Figure 14A:
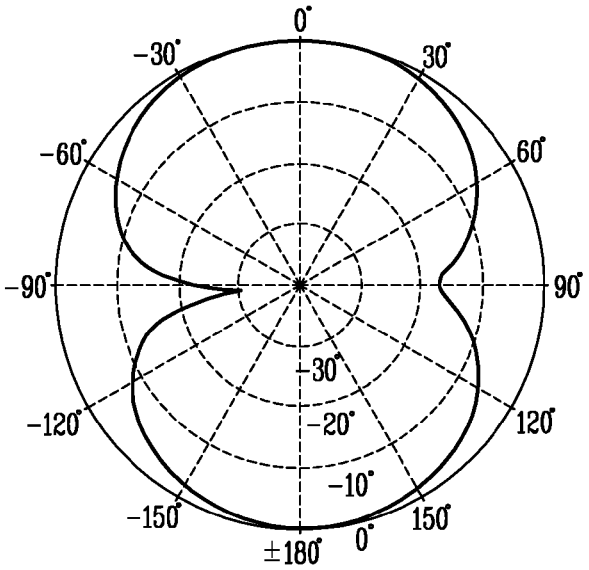
FIGS. 14A and 14B are views showing radiation patterns for E plane and H plane in a low frequency band (2.4 GHz)
Figure 14B:
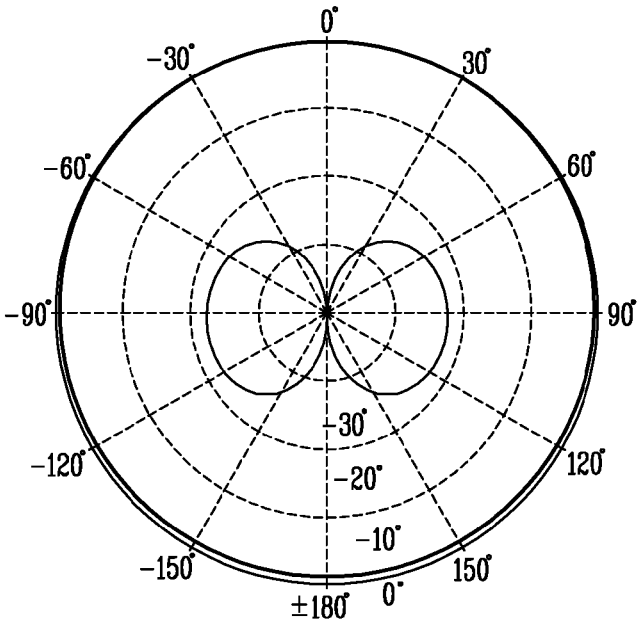
Figure 15A:
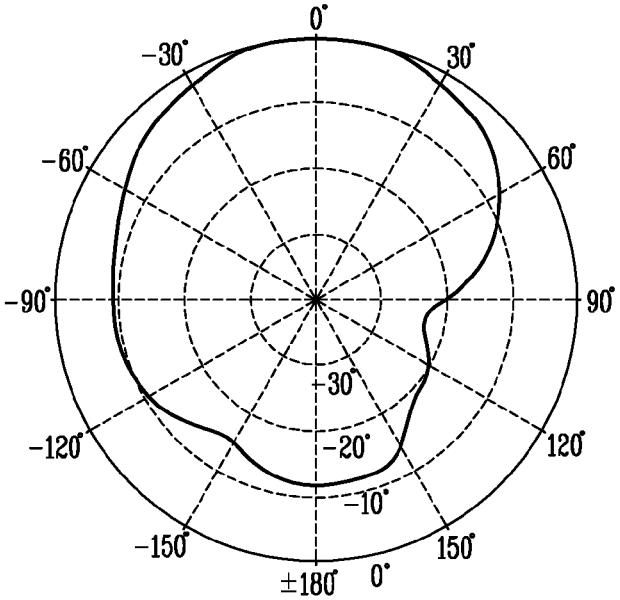
FIGS. 15A and 15B are views showing radiation patterns for E plane and H plane in a high frequency band (6.5 GHz).
Figure 15B:
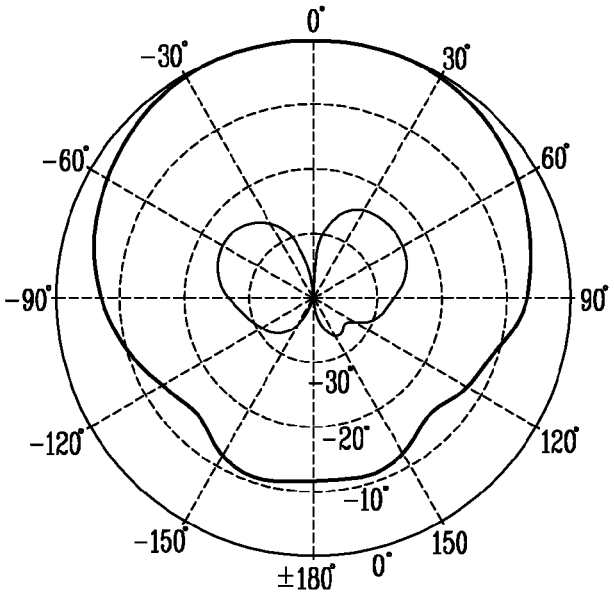

Next, FIGS. 14A and 14B are views showing radiation patterns for an E plane and H plane in a low frequency band (2.4 GHz), and FIGS. 15A and 15B are views showing radiation patterns for E plane and H plane in a high frequency band (6.5 GHz). As shown in the drawings, the forward radiation patterns are formed in the low frequency band due to the DGS 230. On the contrary, asymmetrical radiation patterns are formed in the high frequency band due to the DRA 220 generating the resonances.

With the configuration having the DRA 220 and the DGS 230 connected to the DRA 220, the DRA 220 generates the resonances in the high frequency band and the DRA 220 and the DGS 230 are electromagnetically connected to each other to generate the resonances in the low frequency band. Consequently, the antenna device 200 can be implemented as a dual band antenna device.

Also, the DRA 220 can perform radiation in the high frequency band and load the DGS 230 to perform radiation in the low frequency band, which results in reducing a size of the antenna device 200. In addition, an improved radiation efficiency and wider bandwidth in a high frequency band is achieved by virtue of the DRA 220.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An antenna device comprising:

a dielectric resonator antenna configured to generate resonances in a first frequency band;

a printed circuit board electrically connected to the dielectric resonator antenna and configured to process radio signals; and a defected ground structure formed at the printed circuit board by forming an insulating structure in a ground of the printed circuit board and configured to generate resonances in a second frequency band using a current flowing on the dielectric resonator antenna and the printed circuit board, wherein the defected ground structure comprises first and second insulating parts facing each other with a ground part disposed therebetween on which the current concentrates.

2. The device of claim 1, wherein the ground part is disposed to overlap the dielectric resonator antenna in a thickness direction of the printed circuit board.

3. The device of claim 1, wherein the first and second insulating parts are symmetrical to each other based on the ground part.

4. The device of claim 1, further comprising:

a transmission line disposed at the dielectric resonator antenna and electrically connected to the defected ground structure to excite the dielectric resonator antenna.

5. The device of claim 4, wherein the transmission line is disposed on a side wall of the dielectric resonator antenna and perpendicular to the printed circuit board.

6. The device of claim 4, wherein the transmission line covers the dielectric resonator antenna.

7. The device of claim 4, further comprising:

a connection portion disposed on one surface of the printed circuit board, the connection portion having one end connected to the defected ground structure and the other end connected to the transmission line.

8. The device of claim 1, wherein the first frequency band is a high frequency band, and the second frequency band is a low frequency band.

9. The device of claim 8, wherein the low frequency band is about 2.4 GHz, and the high frequency band is about 5 GHz.

10. The device of claim 8, further comprising:

a transmission line disposed at the dielectric resonator antenna, and electrically connected to the defected ground structure to excite the dielectric resonator antenna; and a connection portion disposed on one surface of the printed circuit board, the connection portion having one end connected to the defected ground structure and the other end connected to the transmission line, wherein the transmission line is connected to the connection portion to form impedance matching of the high frequency band.

11. The device of claim 10, wherein the defected ground structure comprises first and second insulating parts disposed to face each other with a preset interval therebetween, wherein a space between the first and second insulating parts defines a ground part on which the current concentrates, and wherein the ground part is connected to the connection portion and the transmission line to form impedance matching of the low frequency band.

12. A mobile terminal comprising:

a terminal body;

a printed circuit board mounted inside the terminal body and having a ground;

a dielectric resonator antenna configured to generate resonances in a first frequency band; and a defected ground structure formed on the printed circuit board by forming an insulating structure in a ground of the printed circuit board and configured to generate resonances in a second frequency band using a current flowing on the dielectric resonator antenna and the printed circuit board, wherein the defected ground structure comprises first and second insulating parts facing each other with a ground part disposed therebetween on which the current concentrates.

13. The mobile terminal of claim 12, wherein the ground part is disposed to overlap the dielectric resonator antenna in a thickness direction of the printed circuit board.

14. The mobile terminal of claim 12, wherein the first and second insulating parts are symmetrical to each other based on the ground part.

15. The mobile terminal of claim 12, further comprising:

a transmission line disposed at the dielectric resonator antenna and electrically connected to the defected ground structure to excite the dielectric resonator antenna, wherein the transmission line is disposed on a side wall of the dielectric resonator antenna and perpendicular to the printed circuit board.

16. The mobile terminal of claim 15, further comprising:

a connection portion disposed on one surface of the printed circuit board, the connection portion having one end connected to the defected ground structure and the other end connected to the transmission line.

17. The mobile terminal of claim 12, wherein the first frequency band is a high frequency band, and the second frequency band is a low frequency band.

18. The mobile terminal of claim 17, wherein the low frequency band is about 2.4 GHz, and the high frequency band is about 5 GHz.

* * * * *